United States Patent [19]

Kelly

[11] 4,192,116

[45] Mar. 11, 1980

[54] TAPED AND DOUBLE GLUED RUBBER JOINT

[76] Inventor: Thomas L. Kelly, 50 Randolph Ave., Waterbury, Conn. 06710

[21] Appl. No.: 963,193

[22] Filed: Nov. 24, 1978

[51] Int. Cl.[2] ..... B32B 3/00; E04D 1/36

[52] U.S. Cl. ..... 52/469; 52/518; 428/61; 428/161; 428/174; 428/492; 428/493

[58] Field of Search ..... 428/57, 60, 141, 172, 428/492, 52, 101, 61, 161, 162, 493; 52/518, 540, 394, 395, 419, 420, 462, 403, 409, 412, 417, 441, 469; 156/157, 297, 304, 288, 71

[56] References Cited

U.S. PATENT DOCUMENTS

| | | | |
|---|---|---|---|
| 1,732,368 | 10/1929 | Lane | 52/419 |
| 2,420,421 | 5/1947 | Eason | 52/420 |
| 3,475,260 | 10/1969 | Stokes | 428/57 |
| 3,505,770 | 4/1970 | Bennett | 52/540 |

*Primary Examiner*—P. Thibodeau
*Attorney, Agent, or Firm*—Peck & Peck

[57] ABSTRACT

A taped and double cemented or glued rubber joint for use in connecting together the lapped cemented ends of adjacent cured rubber membranes in a roof construction, and for giving protection thereto. The lapping ends of the cured rubber membranes are sealed together by means of cement or the like, providing an adhesive contact system sealing the seam between adjacent membranes. An additional sealing means is provided which is premade and is adapted to be caused to adhere to both portions of both of the overlapping adjacent rubber membranes. This tape or additional sealing means is a composite structure and is applied over the seam between adjacent membranes providing double sealing structure and the tape comprises a lower uncured gum rubber strip which is applied over a portion of one rubber membrane which laps over a portion of the other rubber membrane and also includes a portion which extends over and is cemented to a part of the other membrane and adjacent to the end edge of the rubber membrane. The composite tape also includes a strip of cured reinforced rubber which is adhesively connected to the upper surface of said lower uncured gum rubber strip and is shaped to conform thereto.

2 Claims, 4 Drawing Figures

TAPED AND DOUBLE GLUED RUBBER JOINT

BRIEF SUMMARY OF THE INVENTION

This invention relates to a structure and arrangement sealing the ends of adjacent cured rubber membranes together providing a seam. The rubber membranes are conventionally used in a roof structure, and for other uses, and it is important that a sound seam be provided between adjacent sheets of the rubber membranes. In this invention portions of adjacent membranes are overlapping and the overlapping portions of such membranes are cemented or otherwise adhesively connected together. Thus, one membrane of adjacent membranes has a portion thereof lapped over the adjacent membrane providing an upper portion which is cemented to the underlying portion of the adjacent membrane. A composite tape or sealing means is used and overlays a portion of both of the lapped adjacent membranes and is cemented to the portions of the membranes which it overlays. The premade composite tape is composed of two members which are cemented together and are adapted to overlay and be cemented to the upper portion of one membrane and to overlay and be cemented to a portion of the lower membrane at the lap. The composite tape is composed of a reinforced cured rubber membrane which is cemented to a strip of gum rubber, the two members being flexible and when applied to the seam will conform to the shape thereof.

In the actual field application of structuring seams which may be formed of cured sheet rubber membranes a major problem has been encountered and this problem has been overcome by my structural arrangement. To provide a structural bond by heating or chemically activating the two sheets to be joined together to create a molecularly welded sheet is not possible. It is thought to be standard practice now to use a contact adhesive or a gum tape and glue system between a lap joint and it is a fact that both are difficult to properly work in field application because of the following and other causes:

1. Dirt blowing onto adhesive surfaces.
2. Lap layer of top sheet has to be folded back and carefully applied to bottom sheet without wrinkles or fishmouths.
3. Contact adhesive systems have no peel strength.
4. Contact adhesive systems are protected by a paste caulking which has no chemical bond to membrane sheets and in years of exposure peel off.
5. Gum tape systems are extremely difficult to apply without wrinkling the rubber causing fishmouths.
6. Gum tape has great peel strength but not as great sheer strength.

DETAILED DESCRIPTION

Figure 2:
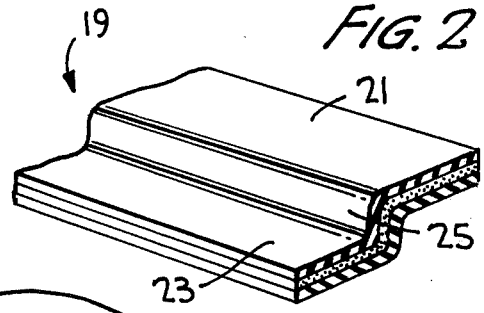
FIG. 2 is a perspective view of a part of the composite tape after application to the joint or seam between adjacent rubber membranes.
Figure 1:
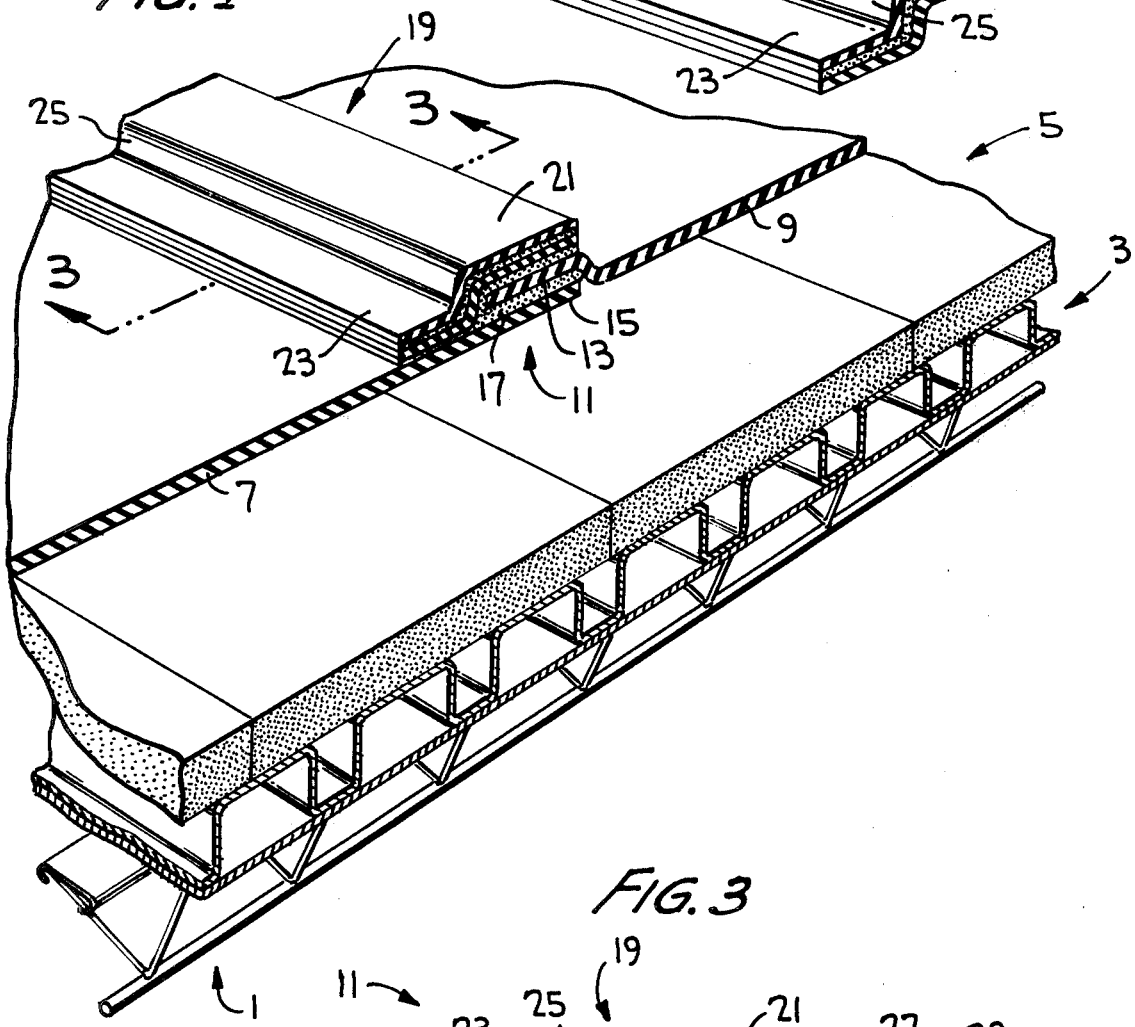
FIG. 1 is a perspective view with parts thereof broken away illustrating the taped and double cemented rubber joint sealing adjacent rubber membranes in a roof construction.
Figure 3:
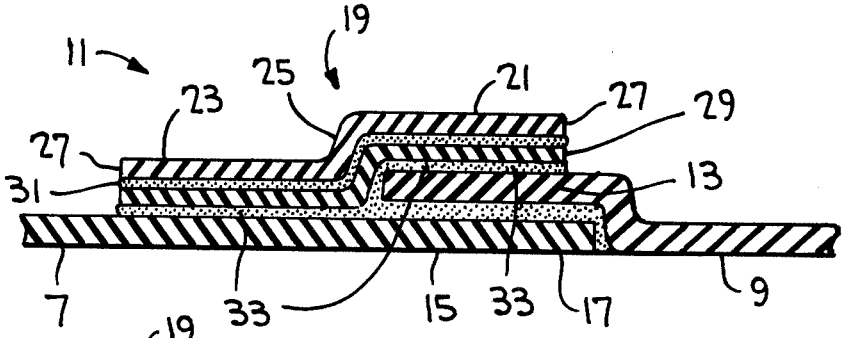
FIG. 3 is a view taken on the line 3—3 of FIG. 1.

In the accompanying drawings, and particularly in FIG. 1, a joint is illustrated in operative position sealing the lapped ends of adjacent cured rubber membranes. The roof construction comprises a steel joist designated generally by the numeral 1 which mounts and supports a steel decking designated in its entirety by the numeral 3 and a plurality of abutting semi-rigid insulation blocks designated generally by the numeral 5, the semi-rigid insulation blocks being mounted and supported upon the decking 3. It is to be distinctly understood that a number of different types of roof structures may be used and still fall within the spirit and scope of this invention since the roof structure per se forms no part of this invention.

Adjacent cured rubber membranes 7 and 9 are mounted on the insulation blocks and may be secured thereto by spot bonding or in any other convenient and suitable manner. The seam or joint between the cured rubber membranes 7 and 9 is designated generally by the numeral 11 and, as will be evident from consideration of the drawings, the portions of the membranes adjacent to the edges thereof are lapped and in this instance I provide a portion 13 of the membrane 9 which overlies a portion 15 of the membrane 7. For clarification of description I shall term the portion 13 of the membrane 9 the "top portion" and the portion 15 of the membrane 7 the "lower portion." The membranes 7 and 9 are each formed of cured rubber and the portions 15 and 13 (respectively) are glued or cemented together by any suitable adhesive material 17 providing a cured rubber adhesive contact system.

In order to overcome the problems and difficulties which have been mentioned above in connection with the seam or joint between membrane elements of this general character and to provide a double seal I have provided a premade composite tape which I have designated generally by the numeral 19. This composite tape is premade and is adapted to be applied over the lapped joint or seam between adjacent membranes. The composite tape when applied to the seam overlays the lapped joint and assumes the shape of the joint caused by the lapping arrangement. The composite tape after assuming the shape of the lapped joint presents an upper portion 21 which is connected to a lower portion 23 by means of a depending skirt 25. The upper portion 21 of the composite tape is formed of reinforced cured rubber 27 and this upper portion 21 is of a width substantially the same as the width 13 of the rubber membrane 9. As mentioned above the composite tape assumes the general shape of the lapped joint when it is applied thereto and thus it presents a depending skirt 25 and a lower portion 23 which is preferably of substantially the same width as the upper portion 21. The composite tape also includes a further strip of uncured gum rubber 29 which assumes the same configuration as the reinforced cured rubber strip 27 which overlies the strip 29. The strips 27 and 29 of the composite tape are glued or cemented together by any suitable adhesive or cement 31, this adhesive connection, of course, being done when the composite tape is formed. The upper portion of the strip 29 which overlies the portion 13 of the membrane 9 is adhesively joined to the lapped portion 13 of membrane 9 by means of any suitable adhesive or cement 33 and this adhesive or cement 33 is also used to cause the lower portion of the strip 29 to adhere to the top surface of the membrane 7. Thus, we have the adhesion of the uncured gummed rubber strip 29 to the cured rubber of the membranes 7 and 9.

It will now be appreciated that I have provided a unique double joint at the seam or jointure of two adjacent cured rubber membranes in a roof or the like structure. It will also now be evident that this system includes the adhesion of lapped portions of cured rubber membranes, thus a standard contact of cured rubber to cured rubber results. When the lapped portions of the rubber membranes are sealed together, as described, and the seam is then doubly sealed by linearly adhesively applying the composite tape over the seam or joint between the cured rubber membranes. The tape upon application to the seam assumes the shape thereof. The composite tape is made of a cured reinforced rubber membrane to which is adhesively joined a strip of gum rubber to which has previously been applied any suitable adhesive. This double adhesive rubber joint endows the composite tape with the necessary peel strength and also the sheer strength required in the lap joint between the rubber membranes. It will be understood by one skilled in this art that the components of the composite tape may be composed of either synthetic or natural rubber and the tape will function as desired.

Figure 4:
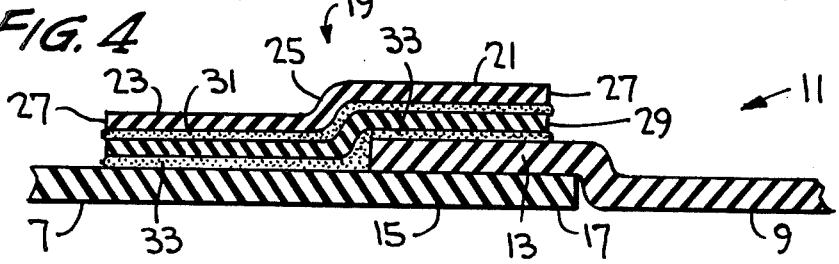
FIG. 4 is a view similar to FIG. 3 only illustrating a modified form of the invention.

In FIG. 4 of the drawings a modified form of the invention is disclosed. It has been my experience that in certain installations it is desirable not to adhesively secure the lapped portions 13 and 17 of the cured rubber membranes 7 and 9 together. Thus, it will be apparent that in the form of the invention disclosed in FIG. 4 the adhesive or cement 33 does not extend between the lapped portions 13 and 17. Instead, it stops at the end of the lapped portion 13 and is provided between the strip of uncured gum rubber 29 and the top of the lap 13 of the membrane 9. When this form of the invention is used the membranes 7 and 9 are lapped as at 13 and 17 and the top portion of the lap 13 of the membrane 9 is cleaned and then the seal 11 is applied thereto as clearly illustrated in the drawing.

What is claimed is:

1. A joint for sealing together end portions of adjacent cured rubber membranes adapted for use in a roof construction, and the like, the end portions of said adjacent cured rubber membranes being lapped and sealed together by adhesive means, and a flexible composite tape element comprising a cured rubber portion overlaying an uncured gum rubber portion, the two portions being adhesively sealed together, said composite tape elements being applied linearly over the joint between the end portions of the cured rubber membranes and being caused to adhere to the end portions of said cured rubber membranes by an adhesive means, and upon application of said composite tape to and over said lapped joint said composite tape assumes the shape of said lapped joint providing with said sealed lapped joint a double seal for the joint between adjacent rubber membranes.

2. A joint in accordance with claim 1 wherein said uncured gum rubber portion of the composite tape is adhesively secured to the overlapping portion of one of said membranes and to a portion adjacent to but removed from the end of the other of said membranes.

* * * * *